US012268261B1

(12) United States Patent
Ogden et al.

(10) Patent No.: US 12,268,261 B1
(45) Date of Patent: Apr. 8, 2025

(54) HAT CAPABLE OF BEING CONVERTED TO A FACE MASK AND BACK TO A HAT

(71) Applicants: William Ogden, Boynton Beach, FL (US); Robert G. Bender, Dallas, TX (US)

(72) Inventors: William Ogden, Boynton Beach, FL (US); Robert G. Bender, Dallas, TX (US)

( * ) Notice: Subject to any disclaimer, the term of this patent is extended or adjusted under 35 U.S.C. 154(b) by 0 days.

(21) Appl. No.: 17/542,447

(22) Filed: Dec. 5, 2021

Related U.S. Application Data

(60) Provisional application No. 63/123,930, filed on Dec. 10, 2020.

(51) Int. Cl.
*A42B 1/006* (2021.01)
*A41D 13/11* (2006.01)

(52) U.S. Cl.
CPC ..... *A42B 1/006* (2013.01); *A41D 13/11* (2013.01)

(58) Field of Classification Search
CPC A41D 13/11; A41D 13/1123; A41D 13/1161; A41D 13/1107; A41D 13/1153;
(Continued)

(56) References Cited

U.S. PATENT DOCUMENTS 167,543 A * 9/1875 Kleinert ..... A41D 13/11 2/206
891,122 A * 6/1908 Wilcox ..... A41D 13/11 2/206

(Continued)

FOREIGN PATENT DOCUMENTS

WO WO-2005000058 A1 * 1/2005 ..... A41D 13/1161

*Primary Examiner* — Heather Mangine
*Assistant Examiner* — Raquel M. Weis
(74) *Attorney, Agent, or Firm* — DANIEL S. POLLEY, P.A.

(57) ABSTRACT

A hat capable of also be used as a face mask. The hat can include a front portion and a conversion member comprising a horizontal retaining strap and a single upwardly extending strap whose both ends are attached to the horizontal strap or a pair of separate straps with a first end of each of the separate straps being secured to the horizontal strap and the second ends of the separate straps being positioned or secured at a top area of the front portion of the hat. The straps can be elastic or stretchable. The horizontal strap has a first end secured to a left lower area of the front portion of the hat and a second end secured to a right lower area of the front portion of the hat. When moving the front portion of the hat over the mouth and nostril area of the wearer in the face mask configuration: (1), where a single upwardly extending strap is provided, a first portion of the single strap is positioned over a left ear area of the wearer and a second portion of the single strap is positioned over a right ear area of the wearer and the elongated member extends along a back area of the wearer's head and a first portion of the elongated member is positioned underneath the left ear area of the wearer and a second portion of the elongated member is positioned under the right ear area of the wearer; or (2) where two separate and independent upwardly extending straps are provided, a first portion of the first strap is positioned over a left ear area of the wearer and a first portion of the second strap is positioned over a right ear area of the wearer and the elongated member extends along a back area of the wearer's head and a first portion of the elongated member is positioned underneath the left ear area of the wearer and a second portion of the elongated member is positioned under the right ear area of the wearer.

7 Claims, 8 Drawing Sheets

(58) Field of Classification Search
CPC ..... A42B 1/006; A42B 1/206; A42B 1/00; A42B 1/22; A42B 1/18; A42B 1/0184; A42B 1/225; A01K 13/006; Y10S 273/17
See application file for complete search history.

(56) References Cited

U.S. PATENT DOCUMENTS 1,057,203 A * 3/1913 Yudelson ..... A42B 1/206 2/172
1,123,354 A * 1/1915 Novoson et al. ..... A42B 1/22 2/195.4
1,134,515 A * 4/1915 Cohoon, Jr. ..... A42B 1/206 D2/893
1,198,824 A * 9/1916 Chandler ..... A42B 1/22 2/195.3
1,485,160 A * 2/1924 Bassan ..... A61F 9/02 128/201.24
1,612,750 A * 12/1926 Stake ..... A61F 9/045 2/209.5
1,624,727 A * 4/1927 Goldberg ..... A61F 9/045 2/209.5
1,673,859 A * 6/1928 Wittcoff ..... A42B 1/02 2/10
2,586,064 A * 2/1952 Landry ..... A61F 9/04 2/10
3,924,388 A * 12/1975 Morrison ..... A61D 7/00 D30/144
4,062,067 A * 12/1977 Franzen ..... A42B 1/22 2/909
4,131,953 A * 1/1979 Kimotsuki ..... A42B 1/205 2/171.1
4,263,679 A * 4/1981 Erlendson ..... A42B 3/085 2/420
4,268,918 A * 5/1981 Lee ..... A42B 1/004 2/172
4,384,371 A * 5/1983 Sonne ..... A42B 1/205 2/209.12
4,593,417 A * 6/1986 Brown, Jr. ..... A42B 1/045 2/205
4,658,446 A * 4/1987 McGill ..... A42B 1/004 446/26
4,741,053 A * 5/1988 Okamura, Sr. ..... A42B 1/22 2/209.12
4,969,317 A * 11/1990 Ode ..... A01K 13/006 54/80.2
5,031,388 A * 7/1991 Ode ..... A01K 13/006 54/80.2
5,035,006 A * 7/1991 Hetz ..... A41D 23/00 2/200.1
5,203,694 A * 4/1993 Klein ..... A42B 1/24 2/171.2
5,239,705 A * 8/1993 Leopold ..... A42B 1/24 132/273
5,253,364 A * 10/1993 Robinson ..... A42B 1/0184 2/209.12
5,321,854 A * 6/1994 Kronenberger ..... A42B 1/225 2/209.3
5,348,510 A * 9/1994 DuPont ..... A63H 3/365 2/209.12
5,551,094 A * 9/1996 Navone ..... A42B 3/121 2/418
5,575,009 A * 11/1996 Ryvin ..... A41D 13/1161 2/202
5,590,422 A * 1/1997 Henderson ..... A41D 20/00 132/273
5,611,118 A * 3/1997 Bibbee ..... A42B 7/00 24/712
5,724,676 A * 3/1998 Amendolia ..... A42B 1/22 2/418
5,771,493 A * 6/1998 Proctor ..... A42B 1/004 2/171.1
5,794,272 A * 8/1998 Workman ..... A42B 3/085 2/421
5,802,617 A * 9/1998 Boden ..... A42C 5/04 2/181.2
5,832,538 A * 11/1998 Williams ..... A42B 1/0187 2/200.1
5,875,488 A * 3/1999 Milani ..... A61F 9/045 2/DIG. 11
D416,665 S * 11/1999 Jones ..... D2/881
6,094,749 A * 8/2000 Proctor ..... A42B 1/248 2/171.1
6,240,566 B1 * 6/2001 Scantlin ..... A42B 1/225 2/209.13
6,421,838 B1 * 7/2002 Frank ..... A42B 1/225 2/195.3
6,446,265 B1 * 9/2002 Moreau ..... A42B 7/00 2/175.7
6,604,975 B1 * 8/2003 Yeh ..... A63H 3/52 2/9
6,607,245 B1 * 8/2003 Scher ..... A47C 7/383 297/393
6,647,553 B2 * 11/2003 Hoyez ..... A42C 5/04 2/209.12
D503,846 S * 4/2005 Gallagher ..... A42B 3/08 D2/881
7,013,491 B2 * 3/2006 Ferrara ..... A42B 1/247 2/10
7,240,372 B2 * 7/2007 Larson ..... A41D 13/11 2/173
D555,331 S * 11/2007 Chun ..... D2/891
7,665,154 B2 * 2/2010 Gerstel Costello .... A42B 1/225 2/195.3
8,381,316 B2 * 2/2013 Edwards ..... A42B 1/006 297/393
8,621,668 B1 * 1/2014 Nolz ..... A42B 5/00 2/171.4
9,192,202 B2 * 11/2015 Adkins ..... A42B 1/041
9,364,369 B2 * 6/2016 Van Stone ..... A61F 5/3707
9,439,466 B2 * 9/2016 Woo ..... A41D 15/00
9,655,396 B1 * 5/2017 Lacy ..... A42B 1/206
10,368,600 B2 * 8/2019 Goldner ..... A41G 5/0093
10,426,211 B1 * 10/2019 Rastinehad ..... A42B 1/006
10,736,369 B2 * 8/2020 Shaw ..... A42B 1/006
11,503,871 B2 * 11/2022 Moran ..... A41D 13/1192
2002/0112273 A1 * 8/2002 Yung ..... A42B 1/206 2/171
2002/0162157 A1 * 11/2002 Hoyez ..... A42B 1/225 2/171
2004/0154081 A1 * 8/2004 Zimmerman ..... A42B 1/22 2/423
2004/0237172 A1 * 12/2004 Quinn ..... A41G 7/00 2/209.13
2005/0066402 A1 * 3/2005 Reitz ..... A41G 7/00 2/9
2006/0010566 A1 * 1/2006 Ridgeway ..... A42B 1/225 2/171
2006/0070160 A1 * 4/2006 Reitz ..... A42B 1/24 2/9
2006/0085881 A1 * 4/2006 Gellis ..... A41D 13/11 2/9
2007/0192934 A1 * 8/2007 Niedrich ..... A42B 1/0184 2/171
2008/0201825 A1 * 8/2008 Chun ..... A42B 1/225 2/209.13
2011/0023214 A1 * 2/2011 Hubbard ..... A42B 1/004 2/206
2011/0232653 A1 * 9/2011 Imashiro ..... B32B 5/022 977/700
2012/0096626 A1 * 4/2012 Edwards ..... A42B 1/006 2/209.13
2013/0212776 A1 * 8/2013 Kim ..... A42B 1/206 2/171.7
2013/0247916 A1 * 9/2013 Symons ..... A41D 13/1161 128/207.11
2014/0130235 A1 * 5/2014 Johnson ..... A42B 1/225 2/209.3

(56) References Cited

U.S. PATENT DOCUMENTS

| | | | | |
|---|---|---|---|---|
| 2017/0064923 | A1* | 3/2017 | Choi | A01K 13/006 |
| 2017/0258165 | A1* | 9/2017 | Thornton | A42C 5/02 |
| 2017/0367421 | A1* | 12/2017 | Dworshak | D06P 3/006 |
| 2018/0255859 | A1* | 9/2018 | Gerstle | A42C 5/02 |
| 2018/0325200 | A1* | 11/2018 | Tunison | A42C 1/00 |
| 2019/0037951 | A1* | 2/2019 | Rue | A42B 1/225 |
| 2019/0059492 | A1* | 2/2019 | Grammer | A42B 1/0188 |
| 2019/0116905 | A1* | 4/2019 | Rybak | A41D 15/04 |
| 2019/0230902 | A1* | 8/2019 | Choi | A01K 13/006 |
| 2019/0365006 | A1* | 12/2019 | Lim | A42B 1/225 |
| 2020/0093212 | A1* | 3/2020 | Zheng | A42B 1/24 |
| 2020/0205508 | A1* | 7/2020 | Shaw | A42B 1/006 |
| 2021/0345702 | A1* | 11/2021 | Volk | A41D 13/11 |
| 2022/0110397 | A1* | 4/2022 | Moran | A42B 1/206 |

* cited by examiner

HAT CAPABLE OF BEING CONVERTED TO A FACE MASK AND BACK TO A HAT

This application claims the benefit of and priority to U.S. Provisional Patent Application Ser. No. 63/123,930, filed Dec. 10, 2020, which is incorporated by reference in its entirety for all purposes.

1. FIELD OF THE DISCLOSURE

The disclosure relates generally to hats and face coverings and particularly to a novel device capable of serving as both a hat and face mask.

2. BACKGROUND

Ordinary hats, such as hat 100A shown in FIG. 1, are common and frequently worn by many as part of their daily activities. Hat 100A can include a brim 102A, a front portion 104A having a plurality of air/vent holes 108A, a back portion 106*a* and a head size adjuster/band 110A. With the appearance of Covid-19 affecting virtually human daily lives throughout the world, more and more individuals wear various types of face mask for protection and in attempt to reduce spread of the disease. The regulations or laws regarding the wearing of a face mask vary from country to country, while at the same time in certain countries it was common to see many individuals wearing face mask/face coverings pre-Covid-19 for protection from other viruses, pollution, pollens, allergies, etc. Covid-19 and its current variants are not expected to go away in the near future, and with seasonal flus and viruses, as well as new viruses and variants, it is foreseeable that the wearing of a face mask will be routine well into the future, as well as for general safety concerns when traveling and spending time in airports. For the hat wearer, currently such individual must remember to separately carry a separate face mask with them. Where the individual is in a hurry, it is common for the individual to leave their residence, office, etc., without taking a face mask with them The current disclosure describes a novel hat that overcomes the problem of an individual forgetting to the bring a face mask with them and also provides for a better fitting face mask, as compared to current one size fits all face mask typically sold on the market.

SUMMARY OF THE DISCLOSURE

A novel hat/device that provides for a headwear/hat, such as, but not limited to, a baseball style cap and a conversion member, which permits the hat to be relatively quickly and easily converted or transitioned from a hat configuration into a face mask configuration, and back into a hat configuration. When a baseball style hat or cap is used, the hat can include a brim, a front portion, a plurality of air/vent holes or eyelets, a back portion and with or without a head size adjuster/band. In a visor like embodiment, the back portion and adjuster/band can be eliminated.

The conversion member can include a horizontally oriented retaining strap (which can be preferably elastic/stretchable though such is not considered limiting) and a pair of upwardly extending/preferably angled retaining straps (which can also be preferably elastic/stretchable though such is not considered limiting) that extend upward and preferably at an angle from the horizontal strap. In one embodiment, the upwardly extending straps can be separate and independent from each other and in another embodiment the upwardly extending traps can be portions of a single strap.

The horizontal strap has a first end secured to a left lower area of the front portion of the hat and a second end secured to a right lower area of the front portion of the hat. Where the upwardly extending straps are separate and independent from each other, each outer end of straps can be inserted through one of the vent holes (preferably in front portion) of the hat and the outer ends can be tied in knots larger in size than the diameters of vent holes such that the outer ends of straps cannot be easily inserted or forced back through the holes and they remain fixedly secured to or abutting the hat at the holes that they are inserted through. The opposite ends of upwardly extending straps can be preferably permanently (though not limiting) secured to the horizontal strap. In the single strap embodiment, the ends of the single strap are both secured (preferably permanently though not limiting) to or at the horizontal strap.

When moving the front portion of the hat over the mouth and nostril area of the wearer in the face mask configuration, where a single upwardly extending strap is provided, a first portion of the single strap is positioned over a left ear area of the wearer and a second portion of the single strap is positioned over a right car area of the wearer and the elongated member extends along a back area of the wearer's head and a first portion of the elongated member is positioned underneath the left ear area of the wearer and a second portion of the elongated member is positioned under the right ear area of the wearer.

When moving the front portion of the hat over the mouth and nostril area of the wearer in the face mask configuration, where two separate and independent upwardly extending straps are provided, a first portion of the first strap is positioned over a left ear area of the wearer and a first portion of the second strap is positioned over a right ear area of the wearer and the elongated member extends along a back area of the wearer's head and a first portion of the elongated member is positioned underneath the left ear area of the wearer and a second portion of the elongated member is positioned under the right ear area of the wearer.

DETAILED DESCRIPTION

Figure 2:
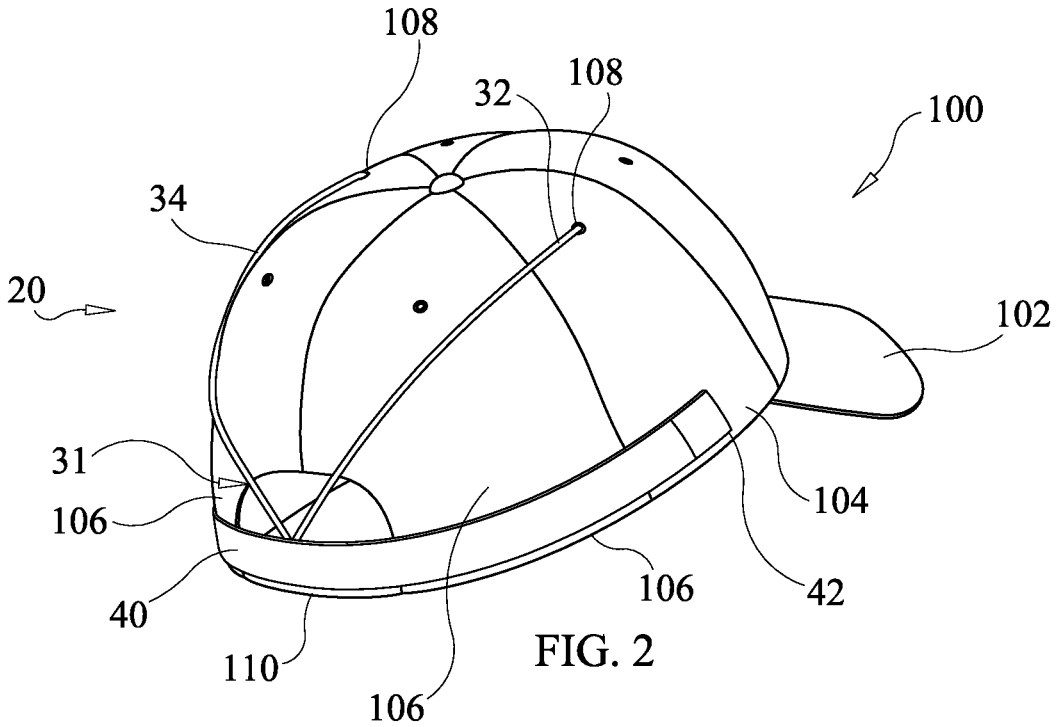
FIG. 2 is a right back perspective view of a novel hat convertible into a face mask and back into a hat shown in a hat configuration in accordance with the present disclosure.
Figure 3:
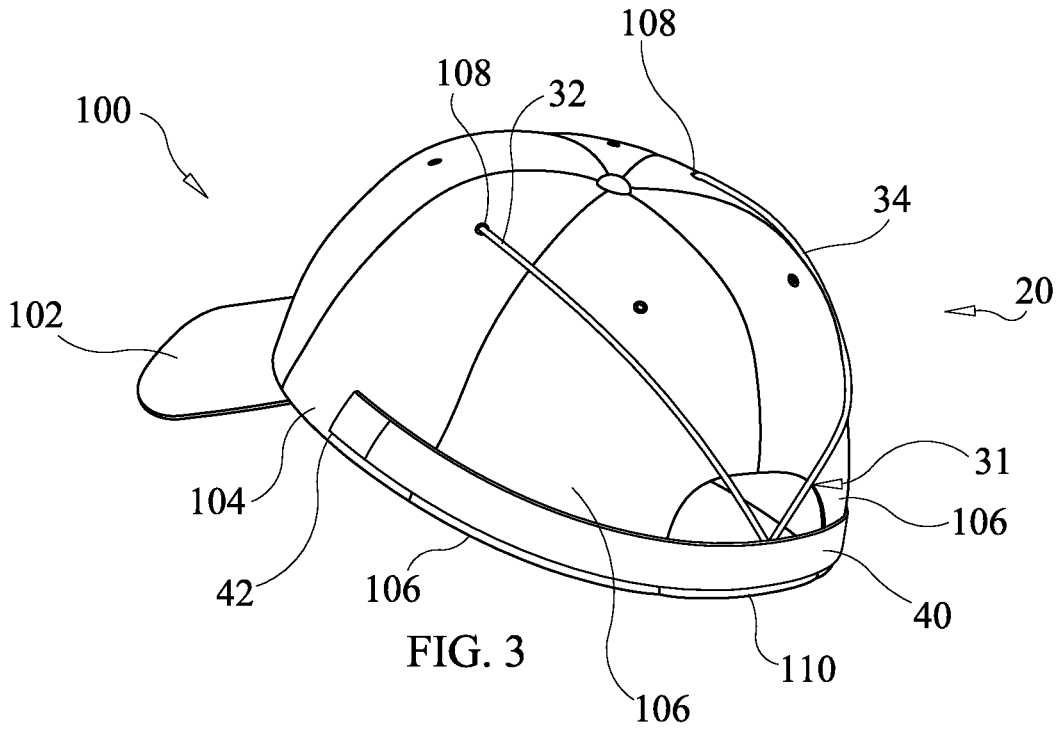
FIG. 3 is a left back perspective view of the novel hat convertible into a face mask and back into a hat shown in a hat configuration in accordance with the present disclosure.
Figure 4:
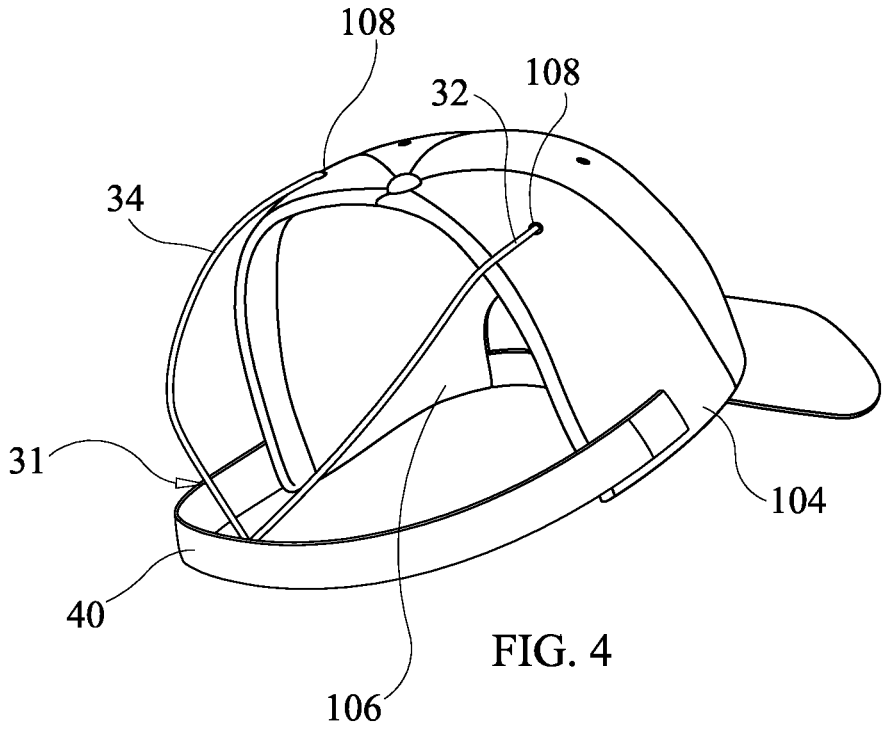
FIG. 4 is a back perspective view illustrating one step in converting/transitioning the hat into a face mask with the back portion of the hat pushed inward against the inside surface of the front portion of the hat (FIG. 13 also illustrates this inward position of the back portion of the hat) in accordance with the present disclosure.
Figure 5:
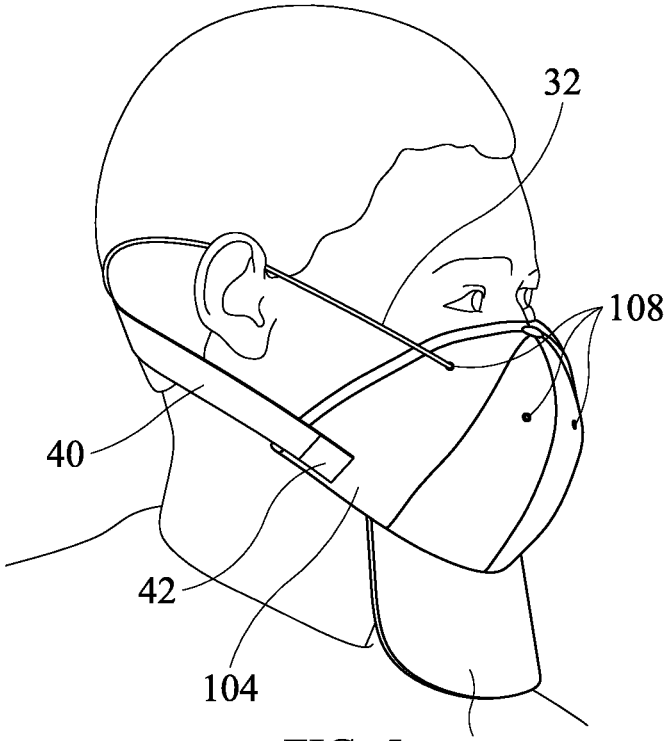
FIG. 5 is a right perspective view of the novel hat convertible into a face mask and back into a hat shown in a face mask configuration in accordance with the present disclosure.
Figure 6:
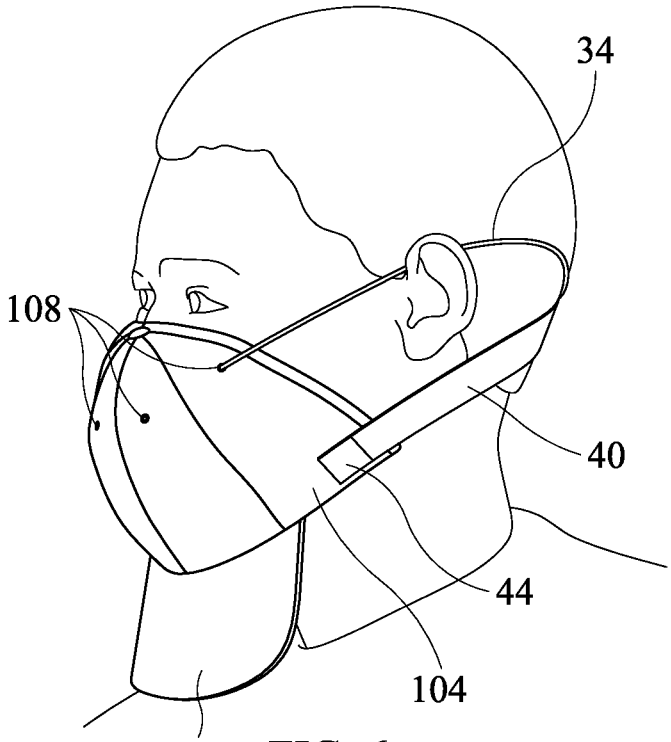
FIG. 6 is a left perspective view of the novel hat convertible into a face mask and back into a hat shown in a face mask configuration in accordance with the present disclosure.

As seen in FIGS. 2-4 a novel hat/device is shown and generally designated as hat/device 20 that provides for a hat, such as, but not limited to, a baseball style cap 100 and a conversion member 31, where device 20 can be easily converted or transitioned from a hat configuration into a face mask configuration, and back into a hat configuration.

Figure 1:
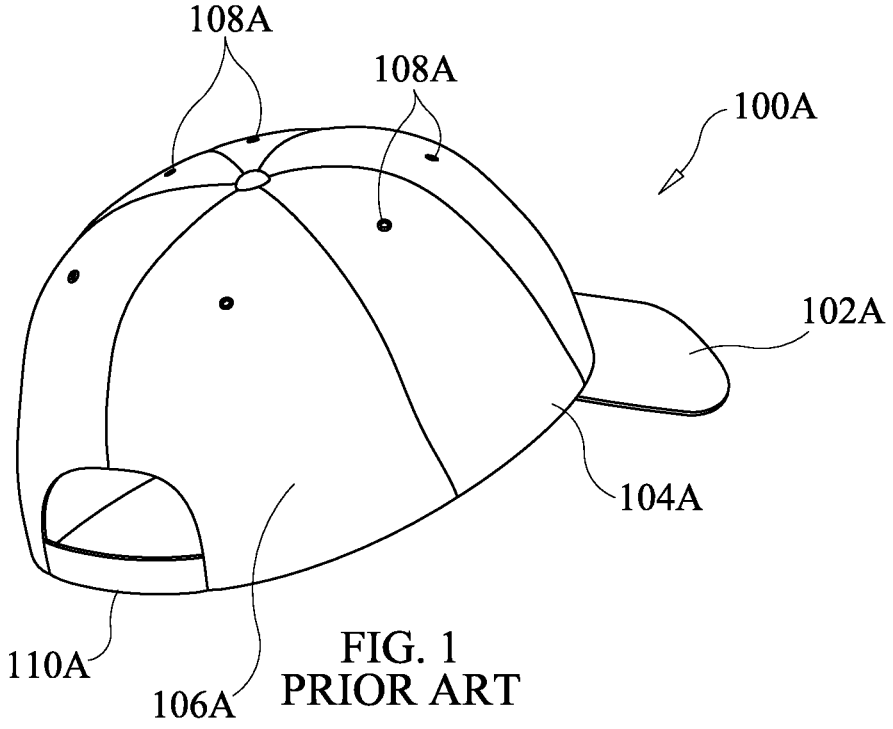
FIG. 1 PRIOR ART
FIG. 1 is right back perspective view of a prior art hat.

In a first embodiment, similar to prior art hat 100A shown in FIG. 1, hat 100 can include a brim 102, a front portion 104 having a plurality of air/vent holes or eyelets 108, a back portion 106 and a head size adjuster/band 110. In a second embodiment (FIG. 14), a visor like hat 200 can be provided where back portion 106 and head size adjuster/band 110 (of the conventional hat 100 or 100A) can be removed and conversion member 31 can be used to retain the hat on the wearer/user during both in the hat configuration and the face mask configuration.

As shown, conversion member 31 can include a horizontally oriented retaining strap 40 (which can be preferably elastic/stretchable though such is not considered limiting) and a pair of upwardly extending/preferably angled retaining straps 32 and 34 (which can be preferably clastic/stretchable though such is not considered limiting) that extend upward and preferably at an angle from strap 40. In one embodiment, straps 32 and 34 can be separate and independent from each other (FIG. 10) and in another embodiment straps 32 and 34 are portions of a single strap (FIG. 11 and FIG. 12).

Figure 8A:
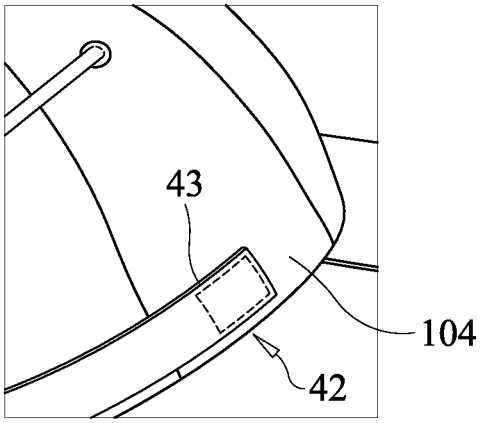
FIG. 8A illustrates a first non-limiting sewing/stitching embodiment for securing the horizontal strap to the hat in accordance with the present disclosure and which also shows that the upwardly angled straps can also be similarly secured to the hat as an alternative to the preferred embodiments shown in FIG. 10 and FIG. 11.
Figure 8B:
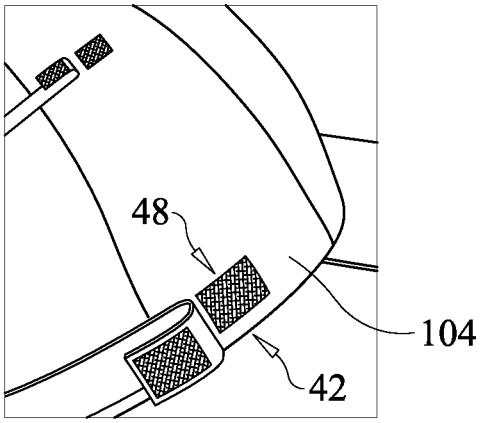
FIG. 8B illustrates a first non-limiting hook and loop fastener (VELCRO™) embodiment for securing the horizontal strap to the hat in accordance with the present disclosure and which also shows that the upwardly angled straps can also be similarly secured to the hat as an alternative to the preferred embodiments shown in FIG. 10 and FIG. 11.
Figure 8C:
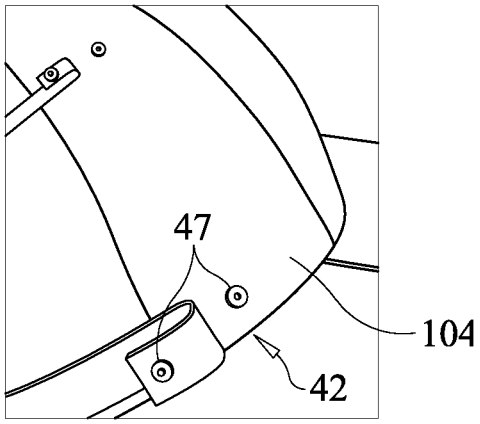
FIG. 8C illustrates a first non-limiting snap assembly embodiment for securing the horizontal retaining strap to the hat in accordance with the present disclosure and which also shows that the upwardly angled straps can also be similarly secured to the hat as an alternative to the preferred embodiments shown in FIG. 10 and FIG. 11.

Strap 40 can include a first end 42 and a second 44. Certain non-limiting embodiments for securing strap 40 to hat 100 are shown in FIG. 8A, FIG. 8B and FIG. 8C. In a first embodiment (FIG. 8A), first end 42 can be permanently attached to a lower right side of front portion 104 of hat 100 and second end 44 can be permanently attached to a lower left side of front portion 104 of hat 100. Any conventional permanent attachment mechanism can be used and can include, without limitation, through sewing/stitching 47, permanent glues, etc. In a second embodiment (FIG. 8B), first end 42 can be removably/releasably attached to a lower right side of front portion 104 of hat 100 though a first hook and loop fastener (i.e. VELCRO™) assembly 45 and second end 44 can be removably/releasably attached to a lower left side of front portion 104 of hat 100 though a second hook and loop fastener (i.e. VELCRO™) assembly 45. As seen in FIG. 8C, a first snap assembly 47 and second snap assembly can also be used in a third securement embodiment and second removable/releasable embodiment. A button/buttonhole assembly can also be used at both ends of strap 40 as another releasable/removable embodiment. Other conventional permanent and removable/releasable strap securement mechanism can also be used and are also considered within the scope of the disclosure.

Figure 10:
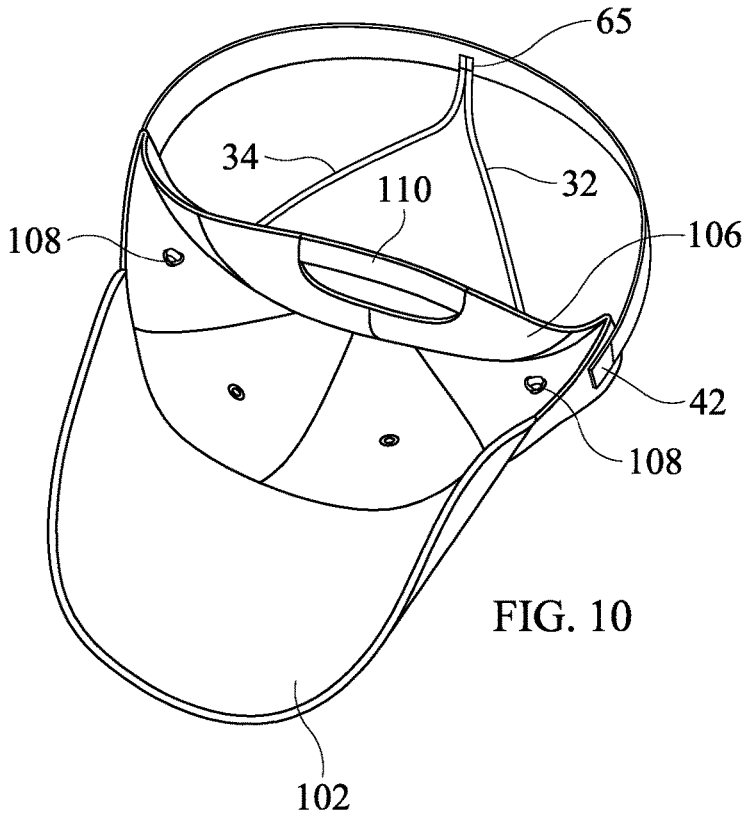
FIG. 10 is a bottom perspective view of the novel hat convertible into a face mask and back into a hat (with conversion to a face mask configuration partially begun) showing a first embodiment where for the upwardly angled retaining straps being separate from each other such that they each have ends that are tied into knots/protrusions once the ends are inserted through corresponding eyelets/holes in the hat to retain/secure the ends to the hat and also illustrates the opposite ends of the upwardly angled retaining straps being securing to the horizontal strap through a fastener/clasp/clamp like device or mechanism in accordance with the present disclosure.

As seen in FIG. 10, where straps 32 and 34 are separate and independent from each other, each outer end of straps 32 and 34 can be inserted through vent holes 108 preferably in front portion 104 of hat 100 and the outer ends are tied in knots larger in size than the diameters of holes 108 such that the outer ends of straps 32 and 34 cannot be inserted or forced back through holes 108 and they remain fixedly secured to or abutting hat 100 at the holes 108 that they are inserted through. As an alternative for tying the outer ends of straps 32 and 34 into knots, other types of protrusions that are also larger in size than the diameter size of holes 108 can also be used and are also considered within the scope of the disclosure. The opposite ends of straps 32 and 34 can be preferably permanently (though not limiting) secured to or at strap 40. The use of securing straps 32 and 34 in connection with air/vent holes 108 is merely one non-limiting example and straps 32 and 34 can be secured and/or anchored to the hat (preferably in a similar location to where holes 108 are provided) by any known or later developed connection/securement mechanism. Thus, straps 32 and 34 are not dependent on the hat having air/vent holes 108.

Figure 11:
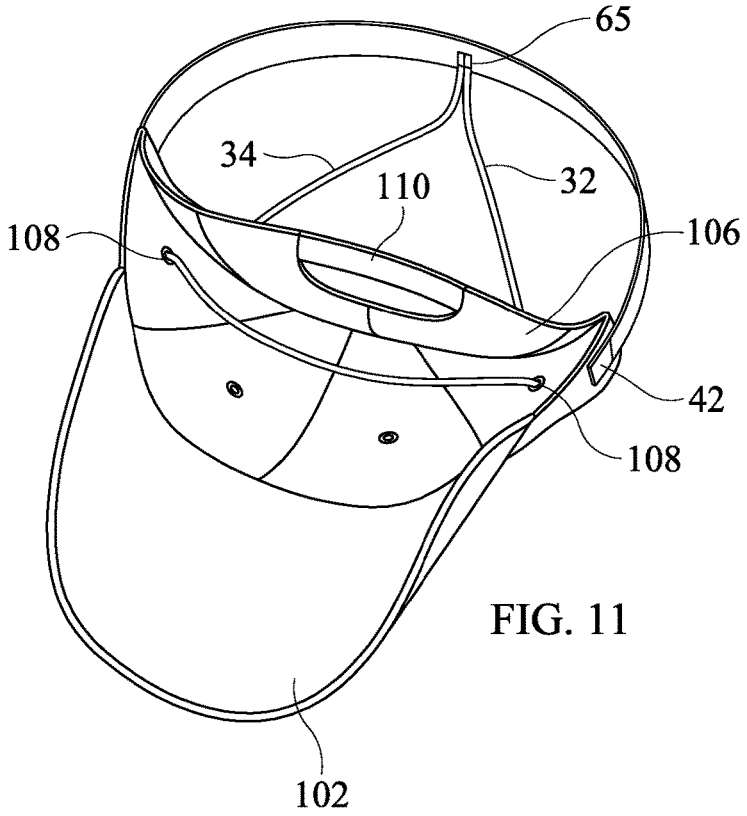
FIG. 11 is a bottom perspective view of the novel hat convertible into a face mask and back into a hat (with conversion to a face mask configuration partially begun) showing a second embodiment where for the upwardly angled retaining straps are portions of a single strap and the strap runs through the eyelets/holes in the hat and the ends of the single strap are secured to the horizontal strap through a fastener/clasp/clamp like device or mechanism in accordance with the present disclosure.
Figure 12:
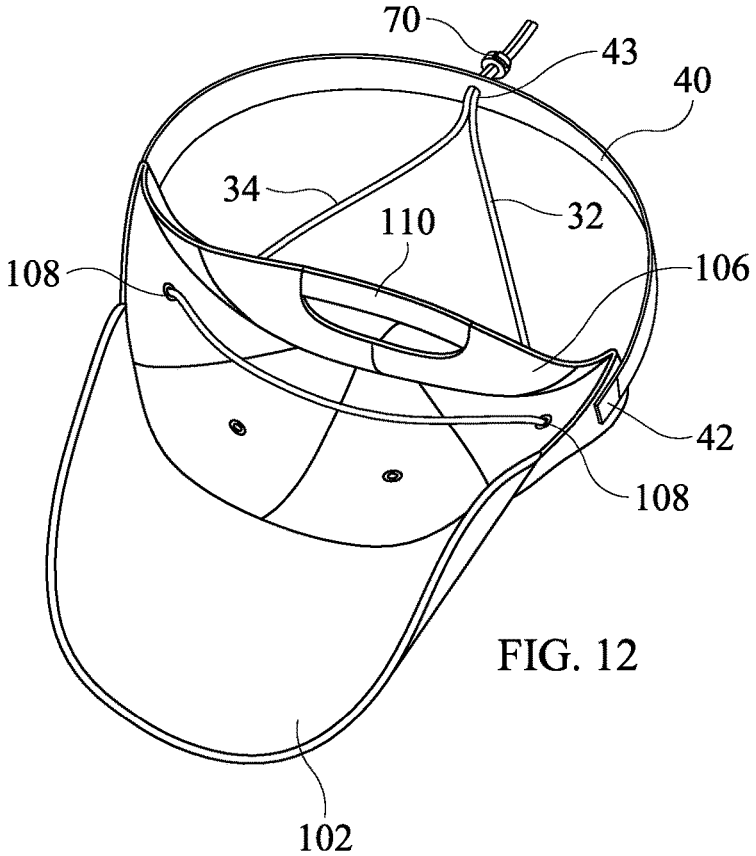
FIG. 12 is a bottom perspective view of the novel hat convertible into a face mask and back into a hat (with conversion to a face mask configuration partially begun) showing the ends of the single strap extending through a hole in the horizontal strap and secured on the outer side of the horizontal strap to a fastener/clasp/clamp like device or mechanism which can also be preferably movable along the strap ends to adjust the angled strap with the head size of the wearer.
Figure 13:
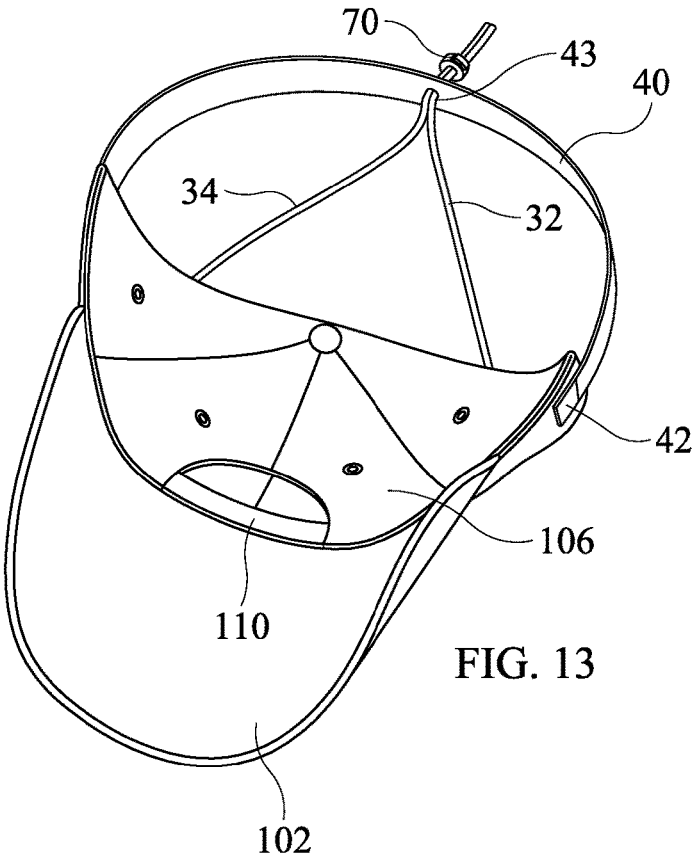
FIG. 13 is a bottom perspective view of the novel hat convertible into a face mask and back into a hat (and in a face mask configuration) showing the ends of the separate upwardly angled retaining straps extending through a hole in the horizontal strap and secured on the outer side of the horizontal strap to a fastener/clasp/clamp like device or mechanism which can also be preferably movable along the strap ends to adjust the angled straps with the head size of the wearer.

As mentioned above, in lieu of two separate straps, straps 32 and 34 can be portions of a single strap (FIG. 11). In the single strap embodiment, the ends of the single strap are both secured (preferably permanently though not limiting) to or at strap 40.

As seen in FIGS. 10-13, the securement of one end of both straps 32 and 34 (where separate) or of both ends of a single strap (i.e. where straps 32 and 34 are portions of the single strap) can be accomplished by any known securement mechanism. In one non-limiting embodiment, the ends can be sewn/stitched to either side of strap 40. In another non-limiting embodiment, the ends can be inserted through or into a clasp/clamp/fastener 65 (that can be permanently secured to either side of strap 40 (FIG. 10 and FIG. 11) preferably on the inside side of strap 40. In a further non-limiting embodiment, the ends can be inserted through a hole or aperture 43 in strap 40 and inserted through or into a fastener 70 that can be adjustably positioned along the length of the single strap or separate straps 32 and 34 (preferably at or near the outside side of strap 40) to provide for a more secure fitting of device 20 to a wearer's head.

Figure 14:
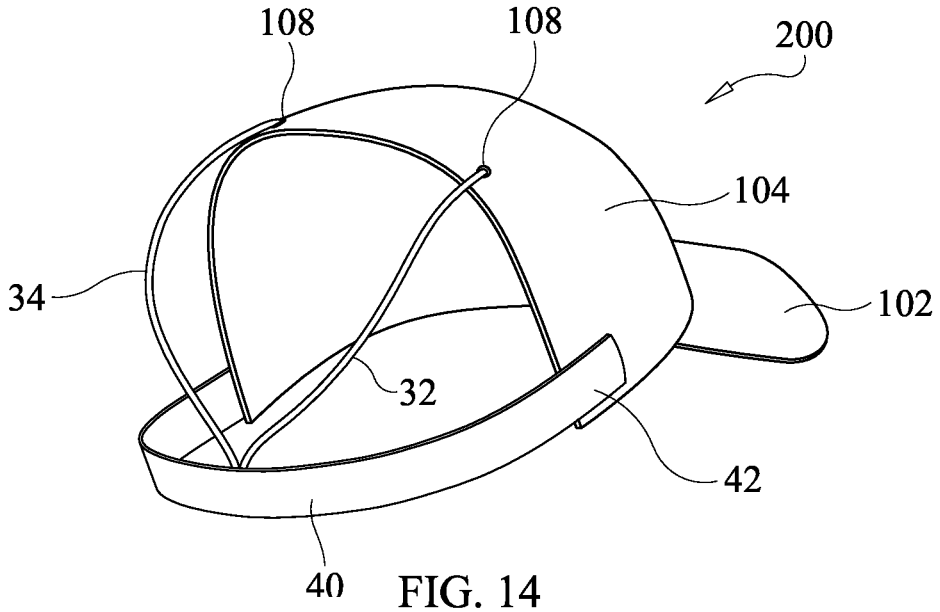
FIG. 14 is a right back perspective view of a novel visor-like hat convertible into a face mask and back into a hat shown in a hat configuration in accordance with the present disclosure.
Figure 15:
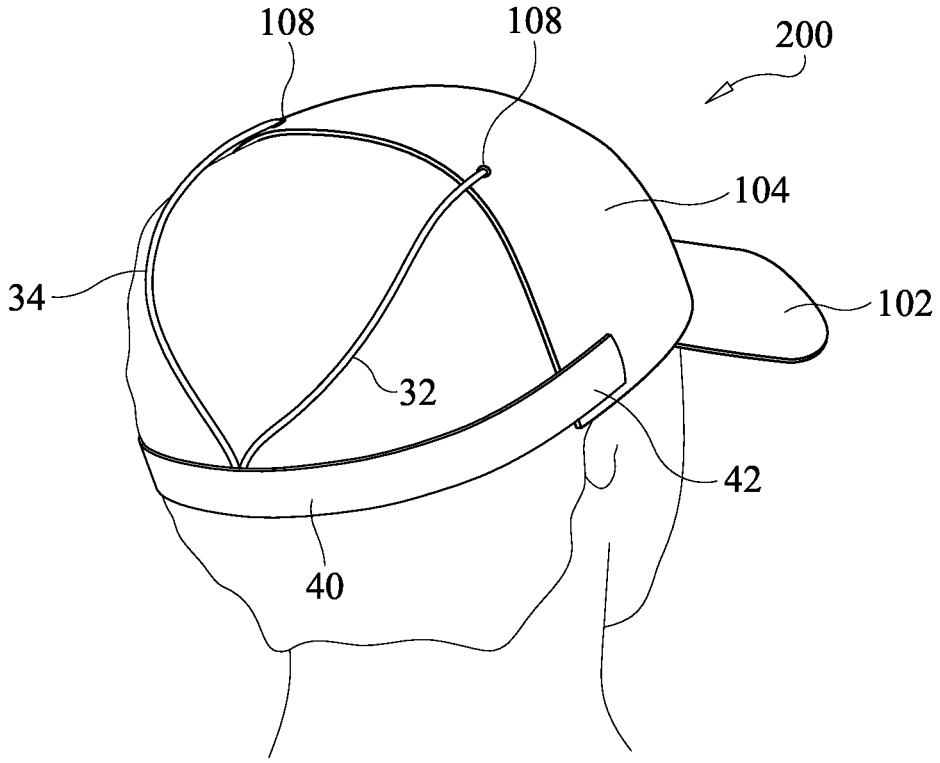
FIG. 15 is a right back perspective view of the novel visor-like hat of FIG. 14 shown in a hat configuration in accordance with the present disclosure.

As discussed above, smaller straps or strap portions 32 and 34 of the single strap can be provided and are positioned across the top surface of back portion 106 of hat 100 and can be secured at front portion 104 of hat 100 (or across the back of the wearer's head in the visor like configuration of FIG. 14 and attached to the front portion 104 of the visor hat). Straps or strap portion s 32 and 34 can be secured/attached/positioned with respect to hat 100 in connection with two holes/eyelets 108 of hat 100 by any conventional attachment method preferably provided in the front portion 104 of hat 100. However, though not preferred, it is within the scope of the disclosure to use eyelets 108 provided in the back portion 106 of hat 100.

Though not considered limiting, on or more of the ends of straps or strap portions 32 and 34 can also be secured to or at strap 40 and/or holes 108 of hat through riveting, anchors, and other conventional attachment mechanisms in addition to the clamp/clasp/fasteners 65 and 70 discussed above.

Additionally, though at least two straps or strap portions 32 and 34 are provided and secured at or near strap 40, it is also within the scope of the disclosure to provide one strap/one strap portion extending upward from strap. In the less preferred use of a single strap, preferably the strap would be centrally located with respect to horizontal strap 40 and be secured at or near a centrally located eyelet in the hat, though such is not considered limiting.

Figure 7A:
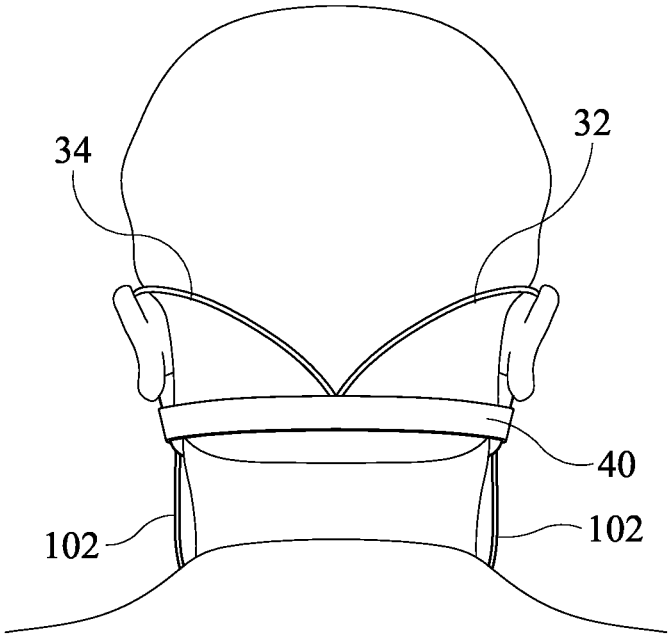
FIG. 7A is a back view of the novel hat convertible into a face mask and back into a hat shown in a face mask configuration in accordance with the present disclosure.
Figure 7B:
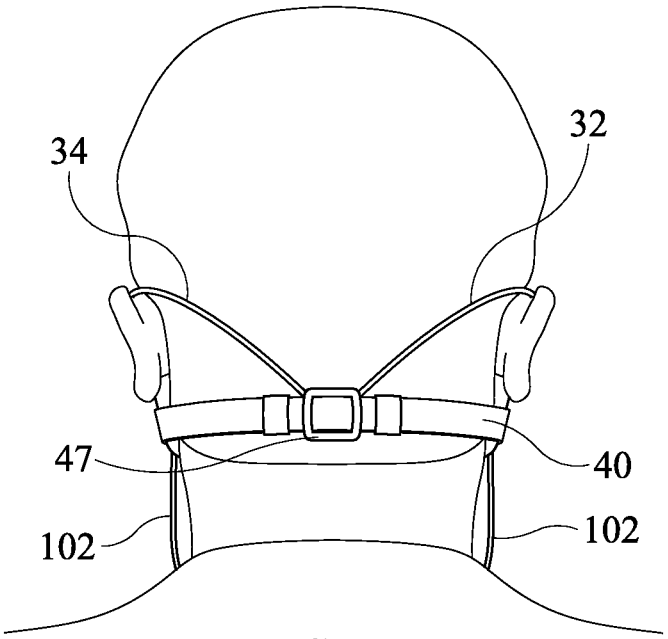
FIG. 7B is a back view of the novel hat convertible into a face mask and back into a hat shown in a face mask configuration in accordance with the present disclosure and showing an adjustable buckle/mechanism provided with the horizontal strap in accordance with one embodiment of the present disclosure.

Preferably, horizontal strap 40 runs along and abuts near or at a back bottom edge of hat 100. Preferably, strap 40 and/or straps/strap portions 32 and 34 can be constructed from an elastic/stretchable material to accommodate different head sizes. It is also within the scope of the disclosure that strap 40 and/or straps/strap portions 32 and 34 can be provided with a conventional length adjustment mechanism (i.e. adjustable length buckle, etc.—See FIG. 7B for a non-limiting example).

In one non-limiting embodiment, the ends of straps/strap portions 32 and 34 that art secured to strap 40 can cross over with respect to each other at the point where they are preferably secured to strap 40 to help keep device 20 symmetrical during use.

The preferred "over the ear" (small straps 32 and 34) and lower head band strap (large strap 40) can be preferably secured through holes/eyelet 108 commonly found on many caps/hats or can be sewn/stitched to the to inside of the cap/hat, as well as being secured by other known or later developed methods such as, without limitation, snaps, hook and loop fasteners ("VELCRO"), button/buttonholes, etc.

In addition to the above securement mechanism, the "over the ear" straps 32 and 34 can be preferably secured at the approximate center of the lower head band strap 40 by any known or later developed connection method, such as, but not limited to, sewing, through an eyelet provided on the lower head band, snaps, VELCRO, button/buttonhole, clasps, clamps, fasteners, etc.

In use, the wearer can preferably pull the novel hat 20 down from the front (i.e. bill of the hat where the hat as a bill or brim or merely pulled down from a front portion where the hat has no bill or brim) causing back portion 106 to abut against the inside surface of front portion 104 such that portions 104 and 106 are positioned over the wearer's mouth and nose area similar to a conventional face mask. Straps/Strap portions 32 and 34 and horizontal strap 40 maintain novel hat 20 in position as a face mask, with straps/strap portions 32 and 34 running along the sides of the wearer's face above or over the wearer's ears and larger strap 40 running around/along the back of the head of the wearer and under the wearer's ears. Thus, in these strap positions, front portion 104 and back portion 106 of hat 20 fully cover the wearer's nostrils and mouth area, similar to a face mask and is tightly retained in position in view of the preferred adjustability/elasticity of one or more of the straps (32, 34 and/or 40), which may create a better seal as compared to a traditional face mask. Additionally, with hat 20, both front portion 104 and back portion 106 serve as filters/blockers of airborne particles in the face mask configuration.

Visor hat 200 is similarly positioned and maintained over the wearer's mouth and nose area. However, as visor hat 200 does not have a back portion 106, only front portion 104 acts as a face mask.

Accordingly, the novel hat/cap 20 or 200 serves as an ordinary hat/cap until it is easily transitioned/converted into a face mask/face covering when needed and preferably can be converted/transitioned while being worn by the wearer by pulling down hat 20 or 200 such that at least front portion 104 covers the wearer's mouth and nose era and straps 32, 34 and 40 function to maintain front portion 104 in position over mouth and nose portion of the wearer's face as described above. Subsequently, the device can be easily transitioned/converted back to a hat/cap when the need for the face mask/face covering has passed.

Thus, with the disclosed novel device, a user/wearer is provided with an easy and convenient way to have his or hat and face mask/covering with them and accessible when needed. Given the position of the straps 32 and 34 with respect to the rest of the hat, straps 32 and 34 can preferably sit on top of the wearer's cars, and preferably do not wrap around the cars, which is known to cause irritation or discomfort to the wearer.

The type of wearer of the disclosed novel device is limitless and basically encompasses all humans, the device is ideal for people with active lifestyles. Some particular types of activities or industries that would benefit by using the disclosed novel device include, without limitation, sports, tennis, golf, travel, resort wear, cruise lines, healthcare, hospitals, policemen, law enforcement, emergency responders, construction workers, contractors, utility workers, lifeguards, service providers, delivery drivers and delivery personal, walkers, bikers, hikers, climbers, etc.

Figure 9:
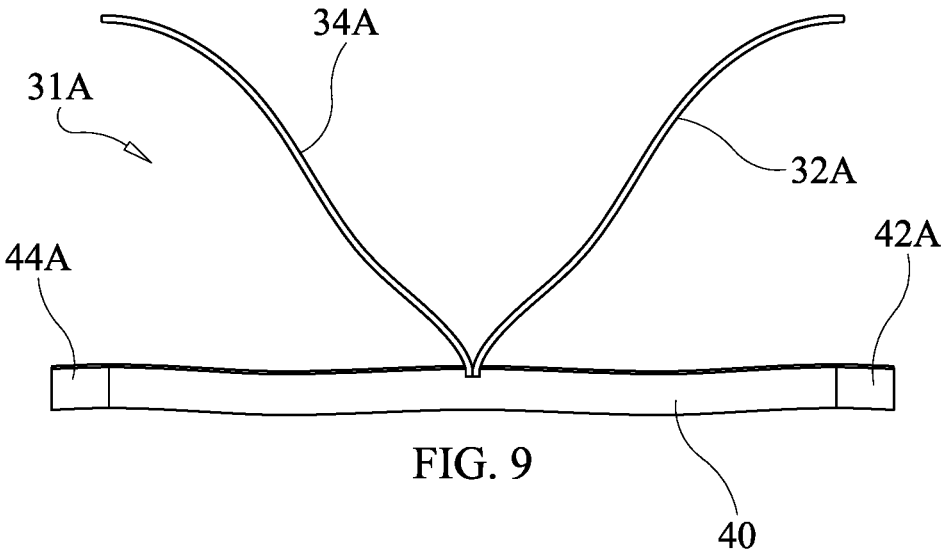
FIG. 9 is front view of a conversion kit that can be attached to a conventional hat, such as the prior art shown in FIG. 1 and/or the visor hat version shown in FIG. 14, for converting/transitioning the conventional hat or visor hat into a hat capable of conversion or transition into a face mask/face covering and back into a hat in accordance with the present disclosure; wherein the strap securement mechanisms shown in FIG. 8A, FIG. 8B and FIG. 8C can be used for the hat/face mask combination hats such as, but not limited to FIG. 2 and FIG. 14 and for securing the conversion kit of FIG. 9 to a conventional hat.

In addition to incorporating straps 32, 34 and 40 into newly manufactured hats/caps for allowing a hat/cap to be converted/transitioned into a face mask/face covering and back to a hat cap, straps 32, 34 and 40 can be provided separately as a conversion kit 31A (See FIG. 9) for securing to existing hats/caps, such as prior art hat 100A shown in FIG. 1. Conversion kit 31A allows an individual to modify their existing hat/cap such that the hat/cap is now able to also serve as face mask/face covering when needed. In one non-limiting embodiment, conversion kit 31A can be made with multiple holes/eyelets on both ends (i.e. preferably 3 to 5 on each side for easy sizing of the larger strap 40A, though such is not considered limiting). With multiple openings on each side, sizing to the wearer's head size can be made easy (i.e. small to large, etc.). One embodiment of conversion kit 31A can be preferably secured to a conventional cap/hat by sewing, eyelet connection, snaps, VELCRO, button/buttonhole, etc. The primary components for conversion kit 31A can be a first upwardly extending strap 32A, a second upwardly extending strap 34A and a horizontal extending strap 40A which function and are secured similar to straps 32, 34 and 40, respectively, discussed above.

In all embodiments, though it is preferred that straps/strap portions 32 and 34 are secured using holes/eyelets 108 such is not considered limiting, and straps 32 and 34 can be secured to other areas or portions of hat 100 or 100A by any conventional securement mechanism regardless and independent of whether hat 100 or 100A is provided with holes/eyelets 108.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the Figures, it will be understood by those of ordinary skill in the art that various changes in form and details may be made therein without departing from their spirit and scope.

All parts and their locations, attachment points, materials, mechanical communication/connection methods, adjustable mechanisms/methods, hat/cap types, dimensions, strap attachment mechanisms, strap adjustment mechanisms, values, activity types, industry types, etc. discussed above or shown in the figures, if any, are merely by way of example and are not considered limiting and other parts and their locations, attachment points, materials, mechanical communication/connection methods, adjustable mechanisms/methods, hat/cap types, dimensions, strap attachment mechanisms, strap adjustment mechanisms, values, activity types, industry types, etc. can be chosen and used and all are considered within the scope of the disclosure.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed, whether during prosecution of this application or in litigation or similar proceeding. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related or could be attributed to the function of the "means for" language.

While the novel hat convertible to a face mask and back has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A hat capable of being used in a hat configuration and converted for use in a face mask configuration to cover a mouth and nostril area of a wearer, the hat comprising:

a hat having a front portion;

an elongated member having a first end permanently attached to a first side of the front portion of the hat and a second end permanently attached to a second side of the front portion of the hat such that the elongated member remains horizontally positioned with respect to the position of the hat at all times, wherein both the first end and the second end of the elongated member are attached at or adjacent to a bottom edge of the lower area of the front portion; and a first strap having a first end directly secured to the elongated member at a central or middle location of the elongated member, the first strap is further secured to a first upper area of the front portion;

a second strap having a first end directly secured to the elongated member at the central or middle location of the elongated member adjacent or next to the attachment of the first end of the first strap to the elongated member, and the second strap is further secured to a second upper area of the front portion which is a different area location of the front portion from the location of the first upper area;

wherein in the hat configuration the front portion of the hat is configured to be positioned on a front top portion of the wearer's head and in the face mask configuration the front portion is configured to be moved downward to cover the mouth and nostril area of the wearer and is maintained in such position over the mouth and nostril area of the wearer by the elongated member and the at least one strap when in use;

wherein when the front portion is in the hat configuration or when the front portion is in the face mask configuration the elongated member maintains the horizontal position adjacent to the lower edge of the front portion.

2. The hat capable of being used in the hat configuration and converted for use in a face mask configuration of claim 1, wherein the hat has a back portion secured to the front portion; wherein when in the hat configuration the back portion of the hat is positioned on a back top portion of the wearer's head, and when in the face mask configuration the back portion is positioned against the front portion of the hat such that both the back portion and the front portion of the hat are positioned over the mouth and nostril area of the wearer; wherein when in the hat configuration the first strap and the second strap are configured to extend flush along the outer surface of the back portion; wherein when in the hat configuration the first end of the first strap and the first end of the second strap are configured to remain positioned at a lower back area of the wearer's head.

3. The hat capable of being used in the hat configuration and converted for use in a face mask configuration of claim 1, wherein the elongated member and the first strap and the second strap are constructed from an elastic or stretchable material.

4. The hat capable of being used in the hat configuration and converted for use in a face mask configuration of claim 1, wherein when in the face mask configuration a portion of the first strap is configured to be positioned over a left ear area of the wearer and a portion of the second strap is configured to be positioned over a right ear area of the wearer, and the elongated member is configured to extend along a back area of the wearer's head, and a first portion of the elongated member is configured to be positioned underneath the left ear area of the wearer and a second portion of the elongated member is configured to be positioned under the right ear area of the wearer; wherein when in the face mask configuration the first end of the first strap and the first end of the second strap are configured to remain positioned at a lower back area of the wearer's head.

5. A hat capable of being used in a hat configuration and converted for use in a face mask configuration to cover a mouth and nostril area of a wearer, the hat comprising:

a hat having a front portion;

an elongated elastic or stretchable member having a first end permanently attached to a first side of the front portion of the hat and a second end permanently attached to a second side of the front portion of the hat such that the elongated member remains horizontally positioned with respect to the position of the hat at all times, wherein both the first end and the second end of the elongated elastic or stretchable member are attached at or adjacent to a bottom edge of the lower area of the front portion; and a first elastic or stretchable strap having a first end directly secured to the elongated elastic or stretchable member at a central or middle location of the elongated elastic or stretchable member, and the first elastic or stretchable strap is further secured to a first upper area of the front portion;

a second elastic or stretchable strap having a first end directly secured to the elongated elastic or stretchable member at the central or middle location of the elongated elastic or stretchable member adjacent or next to the attachment of the first end of the first strap to the elongated elastic or stretchable member, and the second strap is further secured to a second upper area of the front portion which is a different area location of the front portion from the location of the first upper area;

wherein when in the hat configuration the front portion of the hat is configured to be positioned on a front top portion of the wearer's head, and when in the face mask configuration the front portion is configured to be moved downward to cover the mouth and nostril area of the wearer and is maintained in such position over the mouth and nostril area of the wearer by the elongated elastic or stretchable member and by the at least one elastic or stretchable strap;

wherein when the front portion is in the hat configuration or when the front portion is in the face mask configuration the elongated elastic or stretchable member maintains the horizontal position adjacent to the lower edge of the front portion.

6. The hat capable of being used in the hat configuration and converted for use in a face mask configuration of claim 5, wherein the hat has a back portion secured to the front portion; wherein when in the hat configuration the back portion of the hat is configured to be positioned on a back top portion of the wearer's head, and when in the face mask configuration the back portion is configured to be positioned against the front portion of the hat such that both the back portion and the front portion of the hat are configured to be positioned over the mouth and nostril area of the wearer; wherein when in the hat configuration the first elastic or stretchable strap and the second elastic or stretchable strap are configured to extend flush along the outer surface of the back portion; wherein when in the hat configuration the first end of the first elastic or stretchable strap and the first end of the second elastic or stretchable strap are configured to remain positioned at a lower back area of the wearer's head.

7. The hat capable of being used in the hat configuration and converted for use in a face mask configuration of claim 5, wherein when in the face mask configuration a portion of the first elastic or stretchable strap is configured to be positioned over a left ear area of the wearer and a portion of the second elastic or stretchable strap is configured to be positioned over a right ear area of the wearer, and the elongated elastic or stretchable member is configured to extend along a back area of the wearer's head, and a first portion of the elongated elastic or stretchable member is configured to be positioned underneath the left ear area of the wearer and a second portion of the elongated elastic or stretchable member is configured to be positioned under the right ear area of the wearer; wherein when in the face mask configuration the first end of the first elastic or stretchable strap and the first end of the second elastic or stretchable strap are configured to remain positioned at a lower back area of the wearer's head.

* * * * *